US005675946A

United States Patent [19]

Verbeek et al.

[11] Patent Number: 5,675,946

[45] Date of Patent: Oct. 14, 1997

[54] PRIVACY SCREEN FOR OFFICE PANELLING SYSTEMS

[75] Inventors: Steve Verbeek, Aurora; Lorie Marangoni, Weston; Harry Ayvazyan, Willowdale, all of Canada

[73] Assignee: Teknion Furniture Systems, Downsview, Canada

[21] Appl. No.: 660,445

[22] Filed: Jun. 7, 1996

[51] Int. Cl.[6] ..... E04B 2/00

[52] U.S. Cl. ..... 52/205; 52/29; 52/36.1; 52/64; 52/239

[58] Field of Search ..... 52/205, 29, 36.1, 52/64, 239; 49/404, 409, 410; 16/94 R, 95 R, 96 R

[56] References Cited

U.S. PATENT DOCUMENTS 4,335,547 6/1982 Maxwell ..... 52/64 X 4,513,535 4/1985 Uphoff ..... 49/410 X 5,125,202 6/1992 Kissinger ..... 52/64 X 5,282,341 2/1994 Baloga et al. ..... 52/36.1 X 5,471,791 12/1995 Keller ..... 52/64 X

*Primary Examiner*—Christopher T. Kent

[57] ABSTRACT

The privacy screen provides a simple, effective solution to provide visual privacy for the traditional open workstations of office panelling systems. The privacy screen can easily be retrofitted to existing systems without the need for specialized panels or overhead mounting structure at an opening threshold. The privacy screen is mounted to overlap with a face of a panel adjacent a panel and extend there beyond to close the entryway to the workstation.

18 Claims, 8 Drawing Sheets

PRIVACY SCREEN FOR OFFICE PANELLING SYSTEMS

BACKGROUND OF THE INVENTION

The present invention relates to office panelling systems and in particular relates to a privacy screen which can be secured to the office panelling system, adjacent an entryway between panels to allow selective closure of the entryway.

The modern office continues to evolve and office panelling systems provide a great deal of flexibility to address the changing needs of the user over time. Office panelling systems are commonly used for subdividing a large open space into work stations and hallways. Normally the work stations are defined by a group of office panels defining an enclosure with an entryway from the work station to a hallway. For many applications this work station with an open entryway is sufficient and provides the user with some privacy while still being part of an open part of the office. An open entryway also has the ability of providing a greater feeling of space as the work station is opening on to a hallway or larger space.

In some applications it is desirable to be able to close this entryway and in particular, to provide visual privacy from anyone in the hallway outside of the work station.

It would therefore be desirable to be able to provide a simple method for closing of the entryway and in particular, to provide a system which has wide application and is easy to install.

SUMMARY OF THE INVENTION

A system of office panels according to the present invention, subdivide an open space into work stations and at least some of the work stations have an entryway usable by a person between a first panel and a spaced second panel for entering or exiting the work station. A privacy screen is supported by and to one side of the first panel and is movable from a position overlapping and exterior to the first panel, to leave the entryway open, to an extended position closing the entryway. The privacy screen includes an outer frame supporting a non-transparent sheet substrate there within.

The privacy screen as set out above can be relatively light weight and provides visual privacy to the work station when desired. The privacy screen is in contrast to a lockable door which would also provide security to the work station itself. The purpose of the privacy screen is to allow the user to restrict anyone in the hallway adjacent to the work station from observing his work, if the privacy screen is in a closed position. This type of application is particularly desirable for computer programmers and software developers who often have development work displayed on computer monitors.

The privacy screen of the present invention is mounted to the outer face of the first panel and, to a limited extent, encroaches on the hallway. This allows the privacy screen to be easily retrofitted to existing panels defining the entryway.

According to an aspect of the invention, the privacy screen is supported by telescopic slides located between the privacy screen and the panel. According to yet a further aspect of the invention, the telescopic slides have at least three stages with at least 40% overlap between adjacent stages when the privacy screen is in the closed position.

According to a further aspect of the invention, the privacy screen is only supported by telescopic slides located at an upper and lower part of the privacy screen from the first panel. When the privacy screen is in the closed position, it is supported in a cantilevered manner from the first panel.

According to a further aspect of the invention, the sheet substrate is preferably of a translucent plastic material.

According to yet a further aspect of the invention, the substrate is bowed outwardly away from the first panel between vertical sides of the frame of the privacy screen provided about the substrate.

The purpose of the substrate is to provide visual privacy to the work station and therefore it need not be of high structural integrity.

BRIEF DESCRIPTION THE DRAWINGS

Preferred embodiments of the invention are shown in the drawings wherein.

DETAILED DESCRIPTION THE PREFERRED

Figure 1:
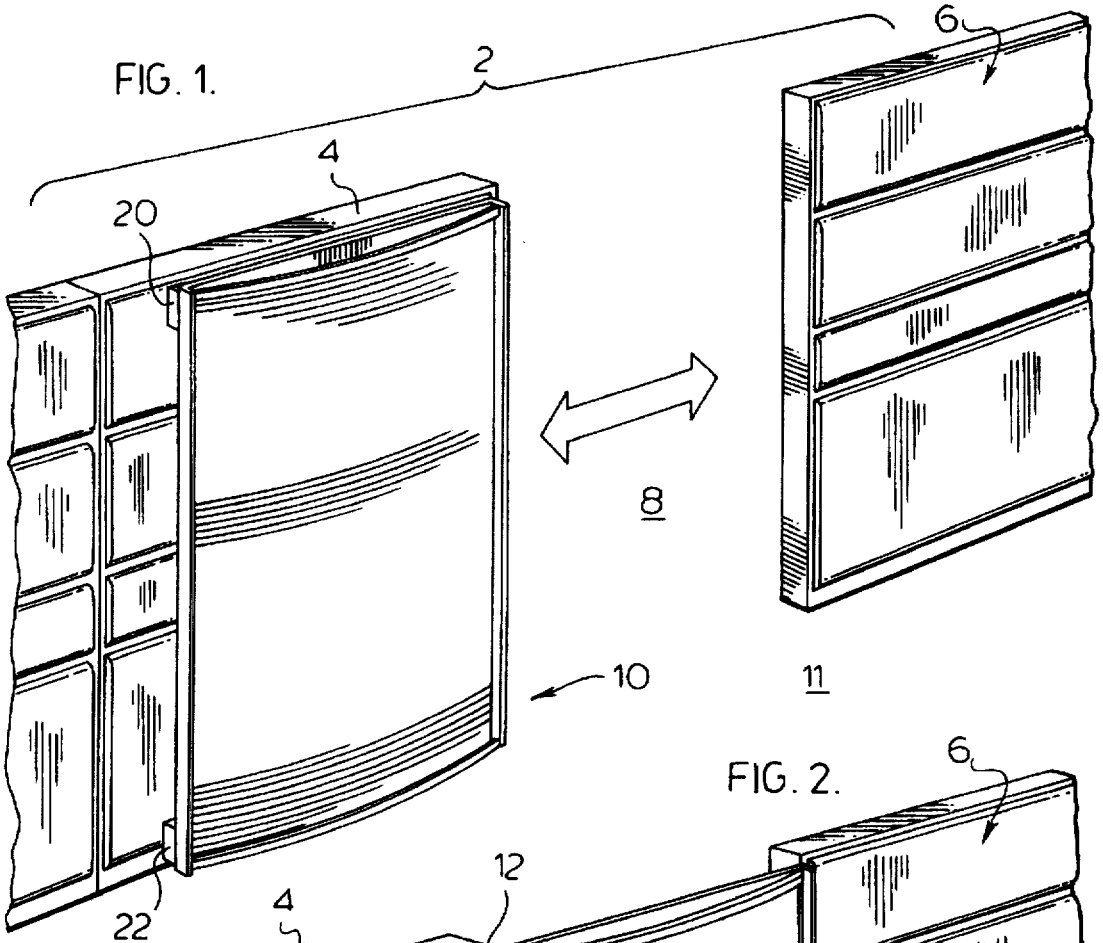
FIG. 1 is a partial perspective view of an office panelling system having an entryway to a work station.
Figure 7:
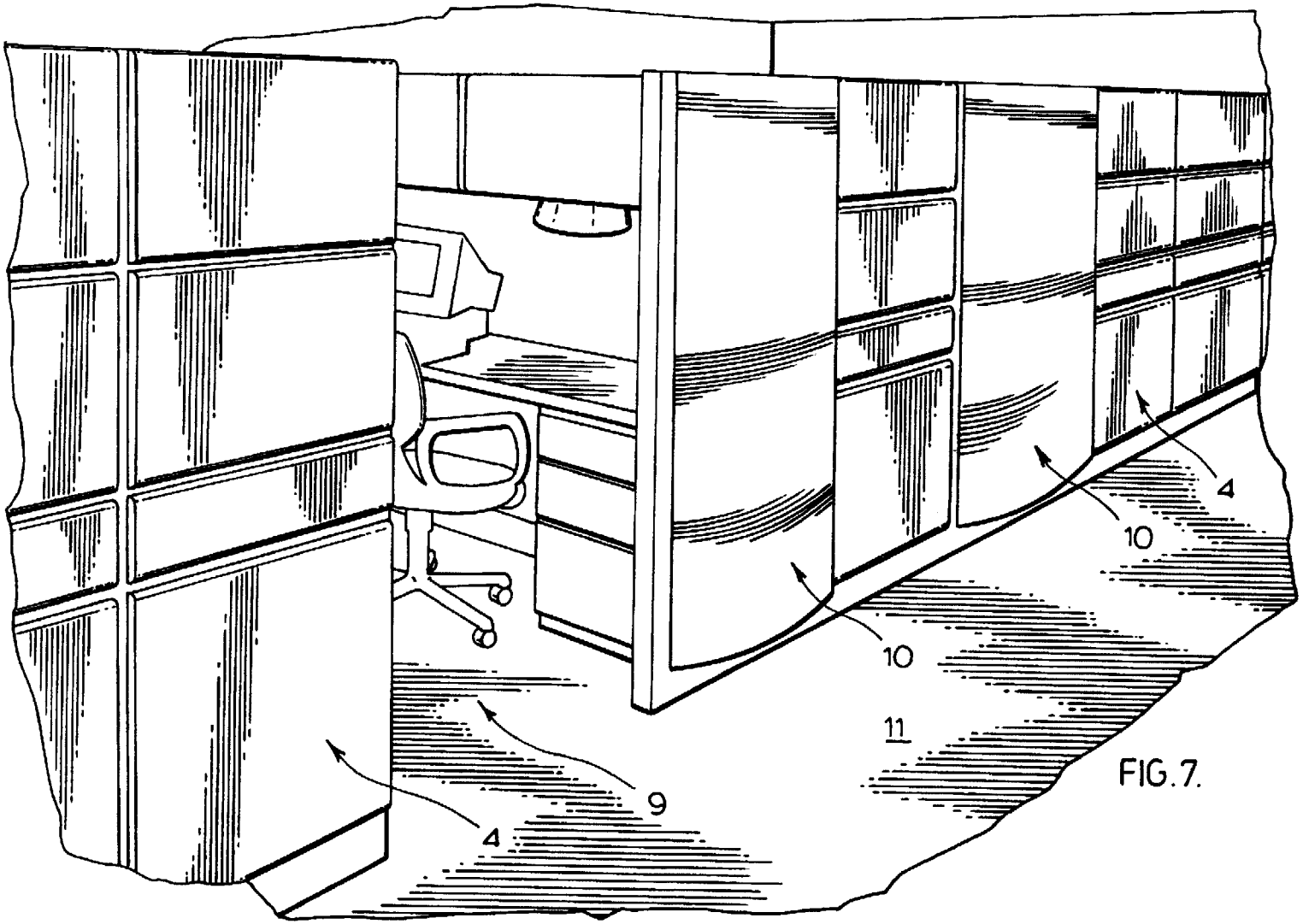
FIG. 7 is a partial perspective view showing an office panelling system with two privacy screens for closing entryways into work stations.

The panelling system partially shown as 2 in FIGS. 1 and 7, is used to define work stations 9, which typically have an entryway 8 opening onto a hallway 11. These panelling systems subdivide large office areas in a convenient manner, also allow convenient reorganization, and can be moved to a new location.

Figure 2:
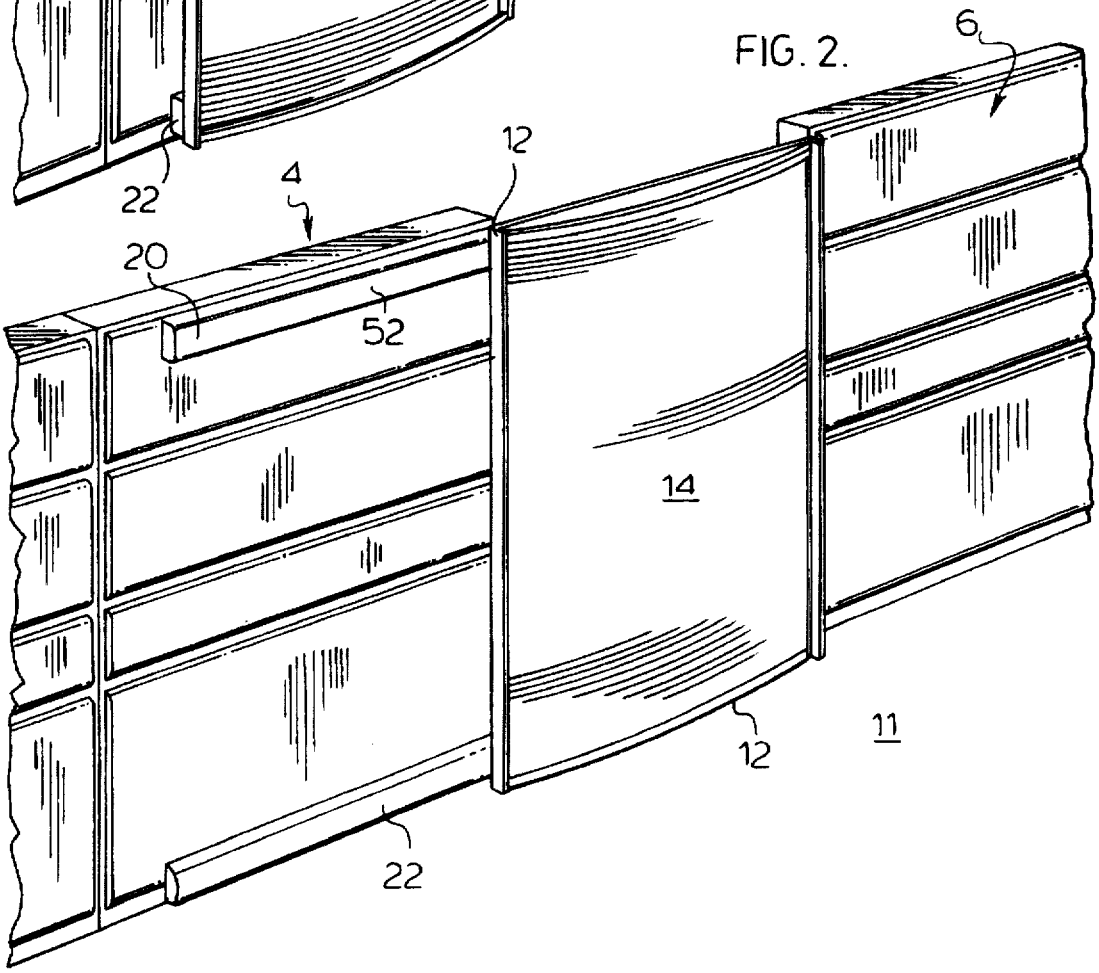
FIG. 2 is a partial view of an office panelling system of FIG. 1 with a privacy screen used to close the entryway.

The privacy screen 10 is moveable from the open position of FIG. 1 to the closed position of FIG. 2 where the workstation is isolated from the hallway.

The privacy screen 10 is supported from the first panel 4, located to one side of the entryway 8, and includes an upper telescopic slide 20 and a lower telescopic slide 22. These telescopic slides preferably have at least three stages with substantial overlap there between in an extended position to allow the privacy screen to be supported in a cantilevered manner from the first panel when the privacy screen is in the closed position of FIG. 2.

The privacy screen includes an outer peripheral frame 12 with a sheet substrate 14 located within the frame 12. Preferably the sheet substrate is of a lightweight translucent plastic (such as THERMOCLEAR LEXAN) to provide visual privacy while still allowing some light into the work station 9. The sheet substrate, shown in FIGS. 1 and 2, is bowed outwardly into the hallway 11 and is held within the frame 12 in a low stressed state. This provides additional structural integrity to the privacy screen and avoids the requirement for intermediate support of the sheet substrate.

Figure 3A:
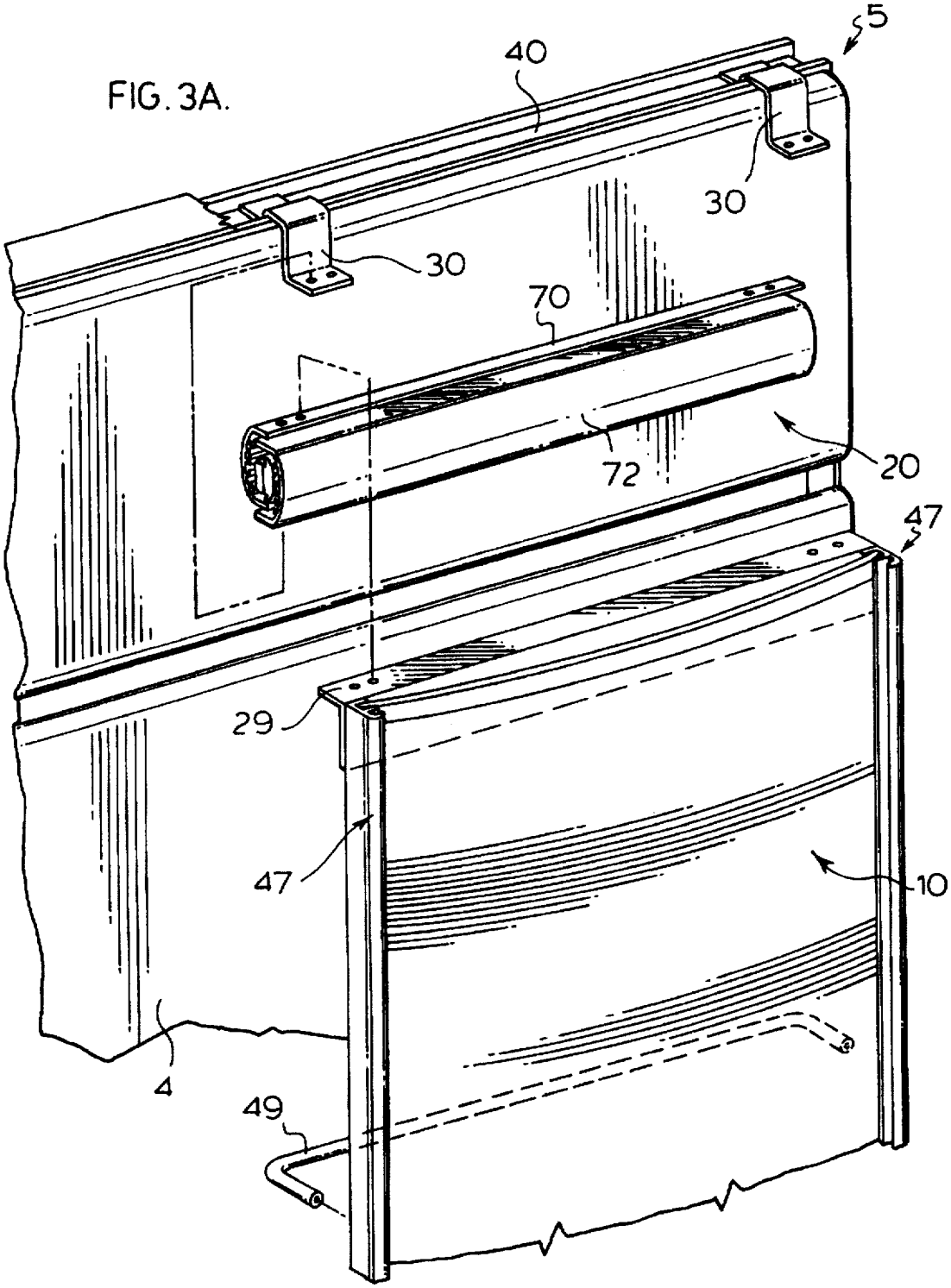
FIG. 3A is an exploded perspective view showing one manner of mounting the upper telescopic slide and curved privacy screen to the office panelling system.

FIG. 3A illustrates securement of the privacy screen 10 to the first panel 4. The first panel 4 includes a structural frame 5 supporting upholstered elements 7. Details of this type of frame are shown in our U.S. Pat. No. 4,535,577, which is incorporated herein by reference. Brackets 30 are mechanically attached to the U-shaped top channel 40 of the office panel frame 5. These brackets serve to provide top support for the privacy screen 10. In a similar manner, the lower telescopic slide 22 is mechanically attached by brackets to the structural frame 5. The telescopic slides 20 and 22 are of a reversible design to allow sliding in either direction. The telescopic slides also provide a finished face to the length of the telescopic slides including the workstation faces of the slides, when the privacy screen is in the closed position.

Figure 3B:
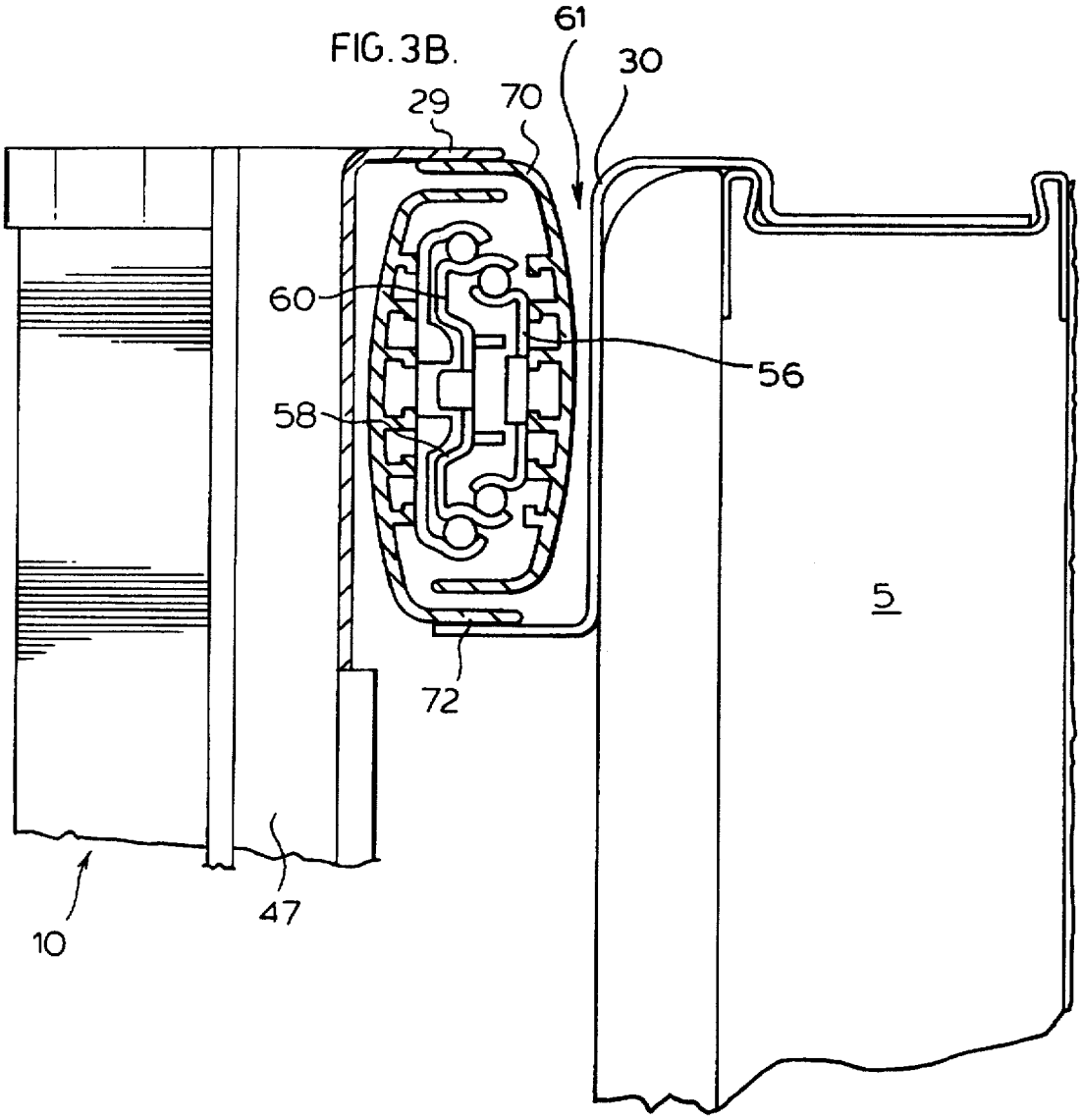
FIG. 3B is an end view showing the interior of the telescopic slide of FIG. 3A.

The privacy screen at an upper edge thereof includes an L bracket 29 which is secured to the structural cover 70 (FIG. 3B). The structural cover 70 moves with the privacy screen 10 and provides a finished face to the workstation side of the privacy screen, which is exposed when the privacy screen closes the entryway. The structural cover 70 has inner slide 56 fixed thereto. Mounting brackets 30 have structural cover 72 attached thereto and cover 72 has outer slide 60 fixed thereto. Preferably, cover 70 and cover 72 are the same. Outer slide 60 and inner slide 56 are interconnected by intermediate slide 58. With this arrangement, L bracket 29 and cover 70 conceal the telescopic slides within the width of the privacy screen 10 and cover 72 conceals the telescopic slides in front of the first panel. The bowed privacy screen 10 is in front of the telescopic slides and the structural covers. Extrusions 47 forming part of the frame of the privacy screen include a projecting handle edge for opening and closing the screen. A horizontal handle 49 strengthens the frame and provides an interior handle.

Figure 4A:
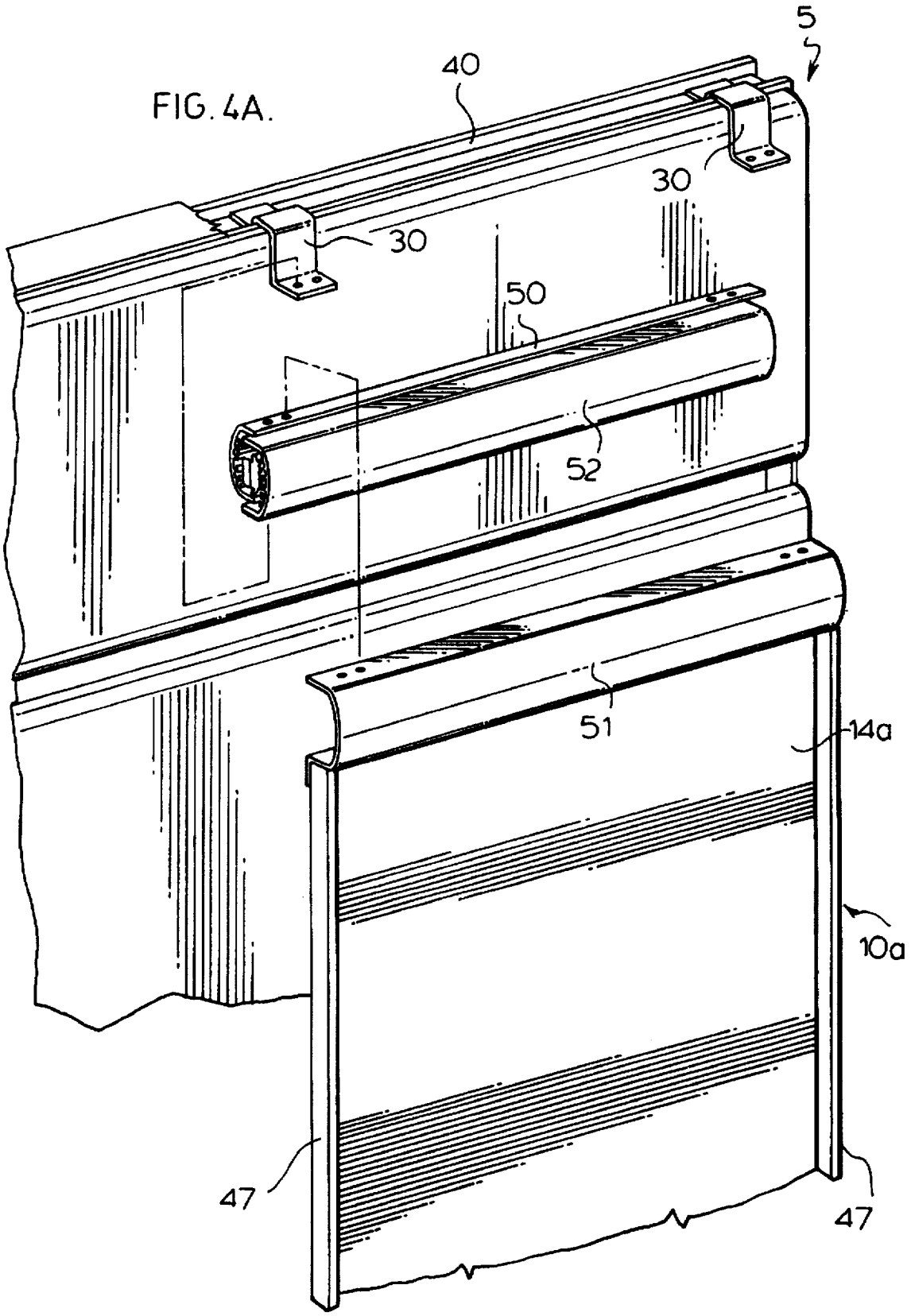
FIG. 4A is an exploded perspective view showing one manner of mounting the upper telescopic slide and a straight privacy screen to the office panelling system.
Figure 4B:
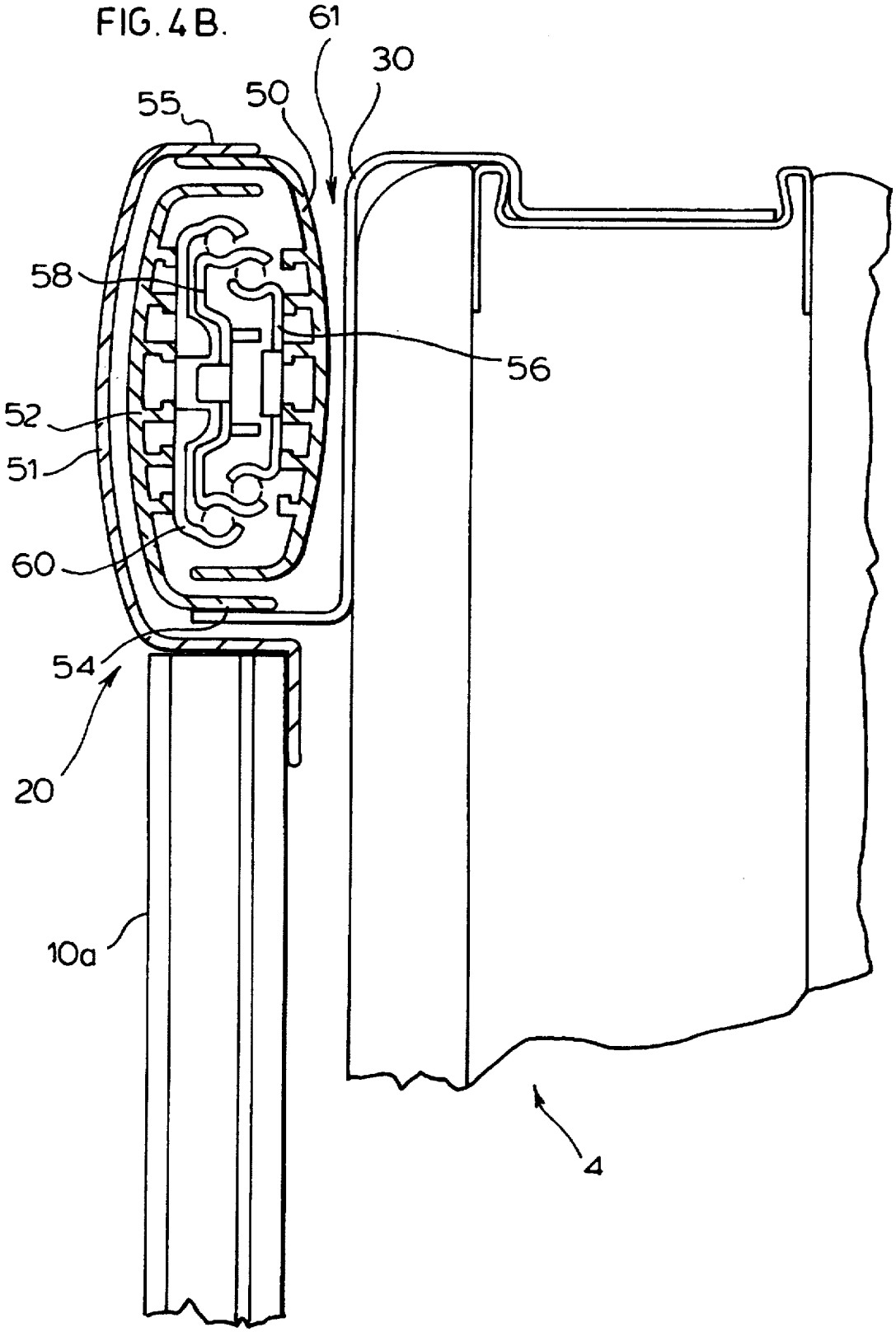
FIG. 4B is a cross-section showing the securement the upper telescopic slide member of FIG. 4A to the office panelling system.

FIGS. 4A and 4B show an alternate arrangement used with a flat privacy screen **10*a*. The privacy screen 10*a* has a flat, lightweight substrate 14*a* to provide visual privacy. The slide 22 includes a stationary structural cover 52 attached at 54 to brackets 30. This cover is exposed when the privacy screen closes the entryway 8. Structural cover 52 defines a top opening channel between the cover and the face of the panel. Outer slide 60 is attached to cover 52 and is stationary therewith. Slide 60 receives and supports the intermediate slide 58 which receives and supports inner slide 56. Inner slide 56 is secured to and stationery with the privacy screen 10*a* which hangs below the slide 20 to keep the privacy screen close to the first panel 4**. The lower telescopic slide is positioned below the privacy screen, thereby keeping the privacy screen close to the face of the panel.

The inner slide 56 is attached to the privacy screen **10*a* by the two connected "C" shaped members 50 and 51 which basically enclose the slides 56, 58 and 60 in a concealed manner. These members include interior slots for securement of the slides. A rearwardly opening gap 61 allows the "C" shaped members 50 and 51 to move without interference from the brackets 30. Member 51 provides a finished surface to the side of the privacy screen facing the hallway and member 50** provides a finished surface to the side of the privacy screen facing the workstation. Both these members move with the privacy screen. The actual mechanical part of the slides is similar to telescopic slides used in filing cabinets.

Once the slides are secured, the privacy screen can then be mounted on the slides. The direction of slide can also be reversed to accommodate right or left hand opening without removing the privacy screen from the panel, which is described with reference to FIG. 8.

Slide 22 is of a construction similar to slide 20 and conceals the mechanical components of the slide in the same manner.

Slides 20 and 22 shown in FIGS. 3 and 4 provide finished surfaces to both the interior and exterior of the workstation covering the slide mechanism when the screen closes the entryway 8 while still providing good structural strength and ease of operation.

With this arrangement, the first slide 56, the intermediate slide 58 and the outer slide 60, which are interconnected by ball bearings and guides, remain hidden from view by member 52 and members 50 and 51 in the flat screen design and members 29, 70 and 72 in the curved screen design.

Figure 5:
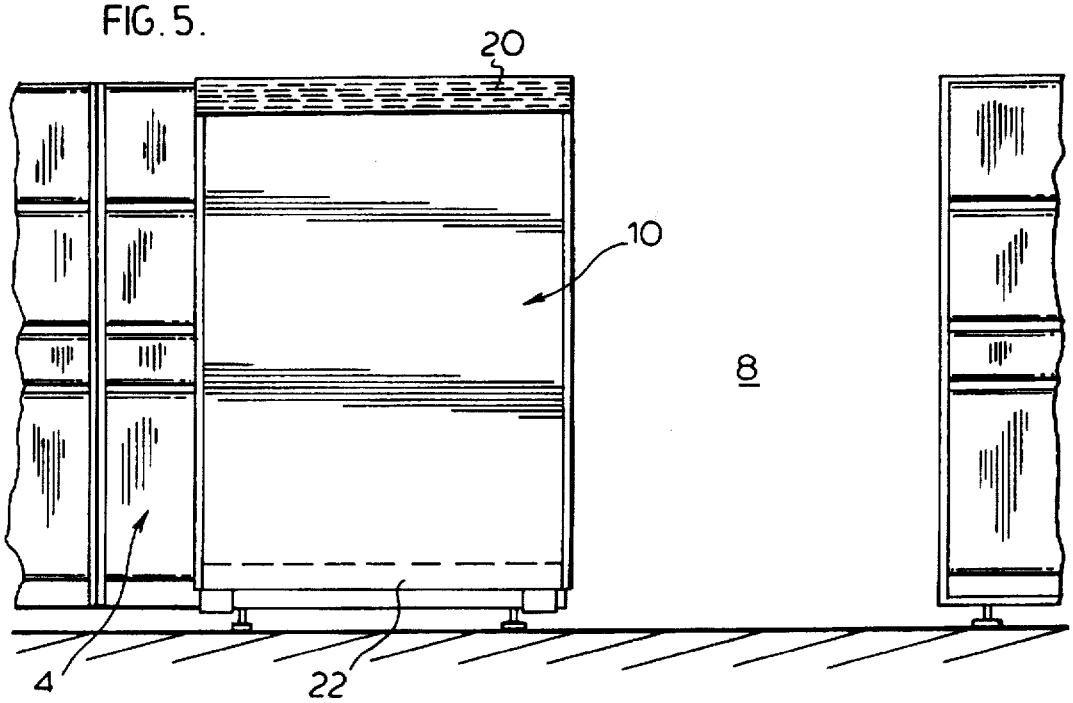
FIGS. 5 and 6 illustrate the privacy screen in an open and closed position respectively.
Figure 6:
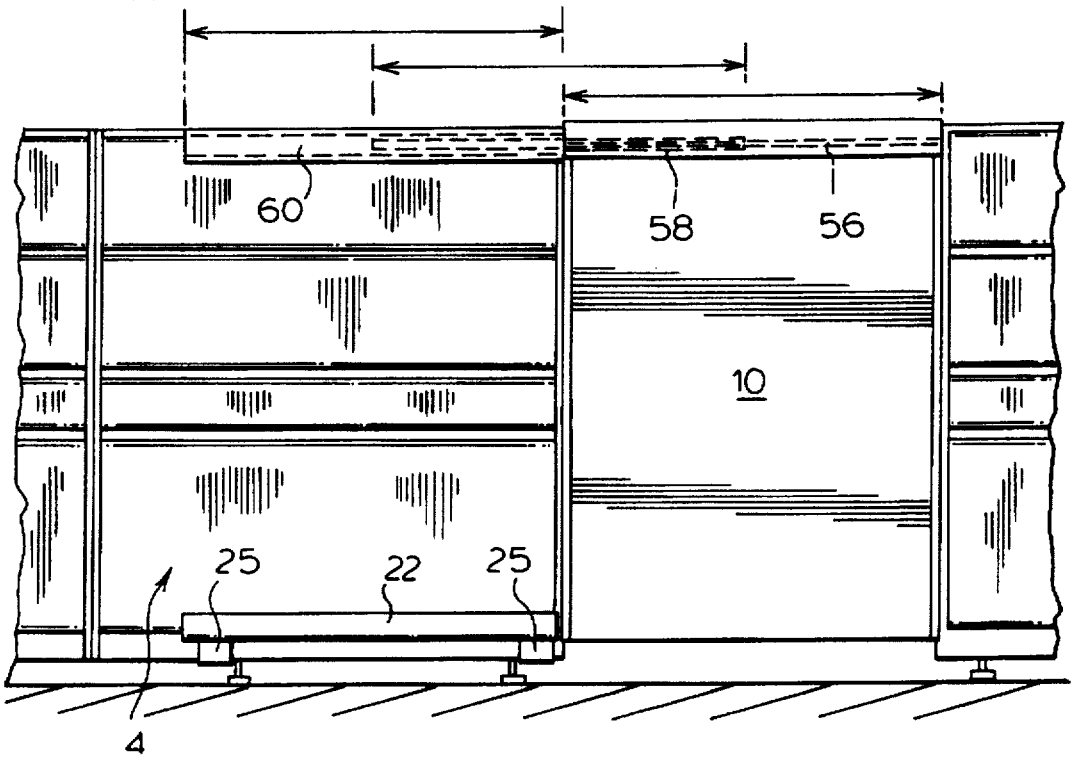

FIG. 5 shows the flat privacy screen 10a and how the slide components 56, 58 and 60, all telescope within each other and allow the privacy screen to overlap with the panel 4 leaving the entryway 8 open. In FIG. 6, the first slide 56 has moved with the privacy screen 10 and as required drawn the intermediate slide 58 therewith. Intermediate slide 58 has at least 40% overlap with slide 56, and outer slide 60. Thus, there remains a very high degree of overlap between the telescopic slide members and this provides sufficient structural stability to support the screen at any position. Slide 22 is mechanically fastened by brackets 25 to the structural frame of the office panel 4. If desired, the privacy screen can releasably engage a support point on the second panel for improved support.

Figure 8:
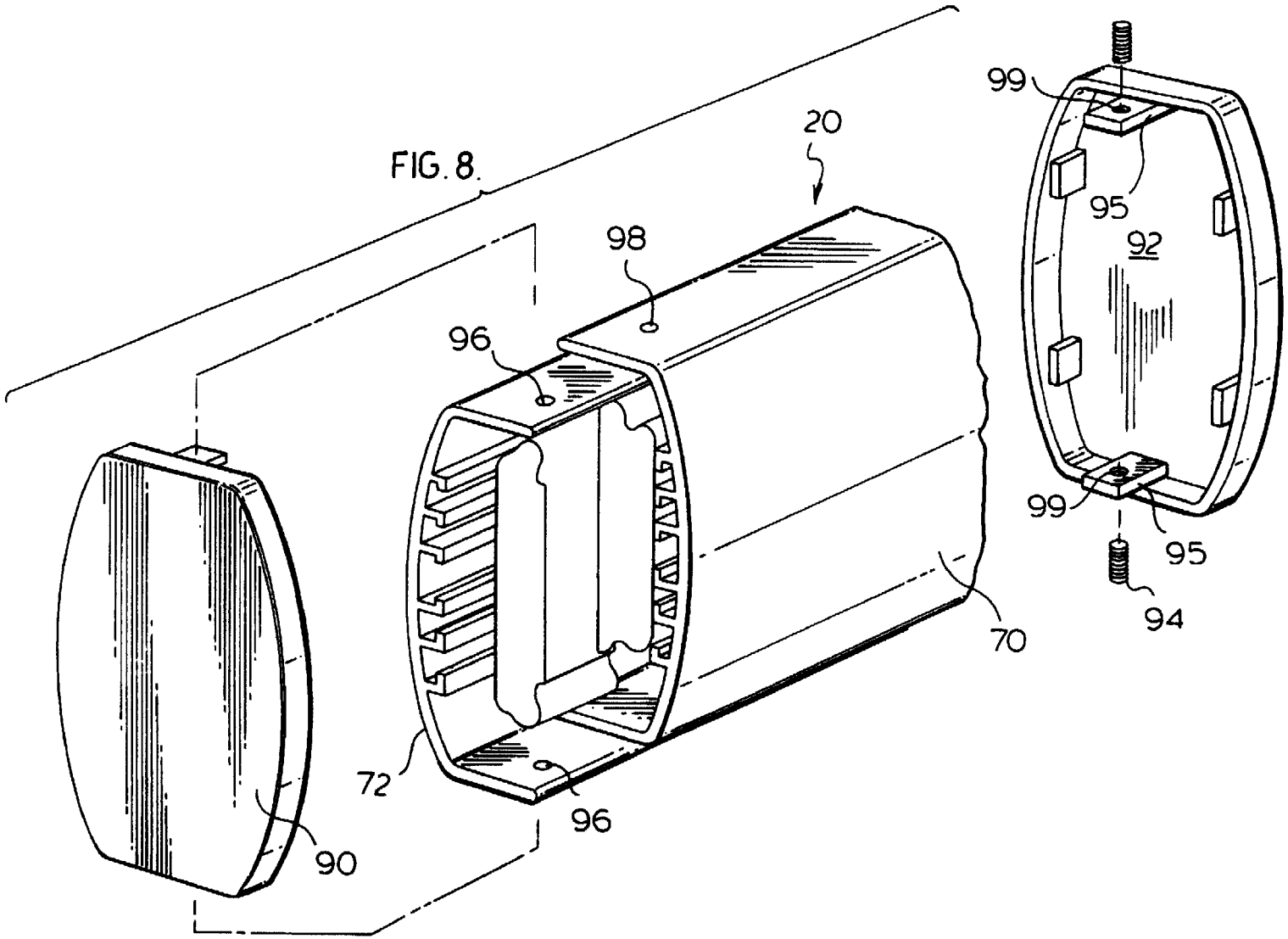
FIG. 8 illustrates end caps used to close the end of the telescopic slide and which form part of a stop mechanism for the slide.

FIG. 8 illustrates how end caps 90 and 92 are attached to the structural covers 70 and 72 of telescopic slide 20 to close the ends of the slide and form a stop mechanism. The slide itself can slide in either direction. End cap 90 is inserted in the end of structural cover 72, which is remote from the entryway. With this cap in place, the slide can only extend in one direction. End cap 92 is inserted in the opposite end of structural cover 72 and moves with the privacy screen. These stop members provide a finished surface at the ends of the telescopic slide. The direction of the slide can be reversed by removing the end caps, extending the slide in the other direction, and reversing the ends of structural covers 70 and 72 to which the end caps 90 and 92 are secured. It can be appreciated from the above that end caps 90 and 92 each form a stop mechanism and define the direction of extension.

End caps 90 and 92 are the same and can be secured in any suitable manner. Set screws 94 can pass through holes 96 or 98 in structural covers 70 or 72 and lock with ports 99 in tabs 95 of the end caps.

It has been found that bowing of the substrate 14 within the rectangular frame 12 of the privacy screen stiffens the substrate and frame and also provides a look which is pleasing to the eye. Depending upon the material being used as the substrate as well as the size of the privacy screen 10, an intermediate support member can be provided at the back of the privacy screen. This support opposes any tendency of the vertical members of the frame 12 to bow outwardly and also forms an interior handle for sliding the privacy screen.

The sheet substrate when made of a translucent plastic is lightweight, provides effective visual privacy and also blends with the existing panel system making it suitable for retrofit applications. The privacy screen can be made in different heights to suit different panel sizes. The most common panel heights are approximately 51 inches and 66 inches. The mounting arrangement and positioning of the slides to one side of the panel allows off module connection and even mounting from across a junction between two panels. With this arrangement there is no requirement to have a panel of a specified width for a given privacy screen. The privacy screen is preferably of a width of about 36 inches.

Other lightweight substrates can also be used to provide a desired look while providing the workstation with visual privacy when desired. The privacy screen can also function to reduce noise to or from the workstation.

The privacy screen is easily adapted to office panel systems of different manufacturers by providing appropriate mounting brackets 25 and 30. These office panelling systems include panels having a rectangular frame with top and bottom horizontal members to which the slides can be secured.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A system of office panels subdividing an open space into work stations with at least some of said work stations having an entryway through which a person can enter or exit one of work stations, each entryway being defined between a first panel and a spaced second panel, a privacy screen supported by and to one side of said first panel and movable from a position overlapping said one side of said first panel and defining an open position to an extended position closing said entryway, and wherein said privacy screen includes an outer frame supporting a non-transparent sheet substrate therewithin, and wherein said privacy screen is supported by at least one telescopic slide attached to said first panel and located intermediate said privacy screen and said first panel.

2. A system as claimed in claim 1 wherein said privacy screen is supported by upper and lowwer telescopic slides intermediate said screen and said panel.

3. A system as claimed in claim 1 wherein said at least one telescopic slide includes an upper telescopic slide attached to a horizontal structural member of said first panel and a lower telescopic slide attached to a structural base part of said first panel.

4. A system as claimed in claim 3 wherein each of said telescopic slides has at least 3 stages with at least 40% overlap between adjacent stages when said privacy screen is moved to said extended position.

5. A system as claimed in claim 4 wherein said privacy screen, between the open position and said extended position, is only supported from said first panel.

6. A system as claimed in claim 5 wherein said privacy screen at positions intermediate said open position said extended position is solely supported from said first panel.

7. A system as claimed in claim 1 wherein said sheet substrate is of a translucent material.

8. A system as claimed in claim 5 wherein said sheet substrate is outwardly curved away from said first panel between vertical sides of said frame.

9. A system as claimed in claim 1 wherein said sheet substrate is bowed outwardly away from said first panel between vertical sides of said frame.

10. A system as claimed in claim 9 wherein said substrate is of a thickness less than one quarter of an inch.

11. A system as claimed in claim 2 wherein said telescopic slides have cover members which conceal mechanical slide components of said telescopic slides to both sides of said privacy screen.

12. A system as claimed in claim 2 wherein each telescopic slide is mounted in a first housing fixed to said first panel and a second housing attached to said privacy screen which telescopes within said first housing, said housings conceal mechanical stages of said telescopic slide from normal view.

13. An office panelling system comprising a plurality of generally rectangular freestanding panels releasably connected to subdivide an open space wherein said rectangular panels include a first panel and a spaced second panel defining therebetween an entryway to a workstation defined by said panels, in combination with a privacy screen mounted on said rectangular panels, and wherein said privacy screen includes a mounting arrangement secured to said first panel to position said privacy screen to one side of said first panel accommodating movement of said privacy screen from a position where said privacy screen is overlapped with said first panel leaving said entryway open to an extended position where said privacy screen closes said entryway.

14. A system as claimed in claim 13 wherein said mounting arrangement includes a telescopic slide with a first end section secured to said first panel and a second end section secured to said privacy screen with said end sections telescoping relative to each other.

15. A system as claimed in claim 14 wherein said telescopic slide is secured to said first office panel and to said privacy screen adjacent an upper edge of said first panel.

16. A system as claimed in claim 15 wherein said telescopic slide includes an intermediate section which interconnects and telescopes with said first and second end sections of said telescopic slide.

17. A system as claimed in claim 13 wherein said mounting arrangement includes upper and lower telescopic slides which support said privacy screen from said first panel.

18. A system as claimed in claim 13 wherein said privacy screen has an outer frame supporting a lightweight non-transparent substrate therewithin.

* * * * *